United States Patent [19]

Martin

[11] Patent Number: 4,845,869

[45] **Date of Patent: * Jul. 11, 1989**

[54] ADVERTISING DISPLAY UNIT FOR A PUBLIC TELEPHONE

[75] Inventor: R. Craig Martin, Houston, Tex.

[73] Assignee: JM Industries, Inc., Houston, Tex.

[ * ] Notice: The portion of the term of this patent subsequent to Nov. 17, 2004 has been disclaimed.

[21] Appl. No.: 97,684

[22] Filed: Sep. 17, 1987

Related U.S. Application Data

[63] Continuation of Ser. No. 822,208, Jan. 24, 1986, Pat. No. 4,706,399.

[51] Int. Cl.[4] ..... G09F 7/00

[52] U.S. Cl. ..... 40/584; 40/336; 379/453

[58] Field of Search ..... 40/339, 584, 625, 606, 40/210, 371, 626; 52/38, 27; 379/451, 453

[56] References Cited

U.S. PATENT DOCUMENTS

| | | | |
|---|---|---|---|
| 3,247,332 | 4/1966 | McHugh | 379/453 |
| 4,271,622 | 6/1981 | Tippmann et al. | 40/611 |
| 4,706,399 | 11/1987 | Martin | 40/336 |

*Primary Examiner*—Gene Mancene
*Assistant Examiner*—Cary E. Stone
*Attorney, Agent, or Firm*—Dodge, Bush & Moseley

[57] ABSTRACT

A vandal resistant mounting method and apparatus for an advertising display unit for use with a public telephone is disclosed. The advertising display unit mounting comprises a vertical post having, a recessed support in a front opening to secure the public telephone, and an advertising unit including a display wall having an aperture. The mounting disclosed operably prevents removal of the display wall from the post. The display wall has at least one laterally outwardly extending wall section adjacent the aperture of the unit for display of advertisements. Additionally, a transparent covering is attached to the display wall to operably shield the advertisements.

1 Claim, 1 Drawing Sheet

FIG. 1
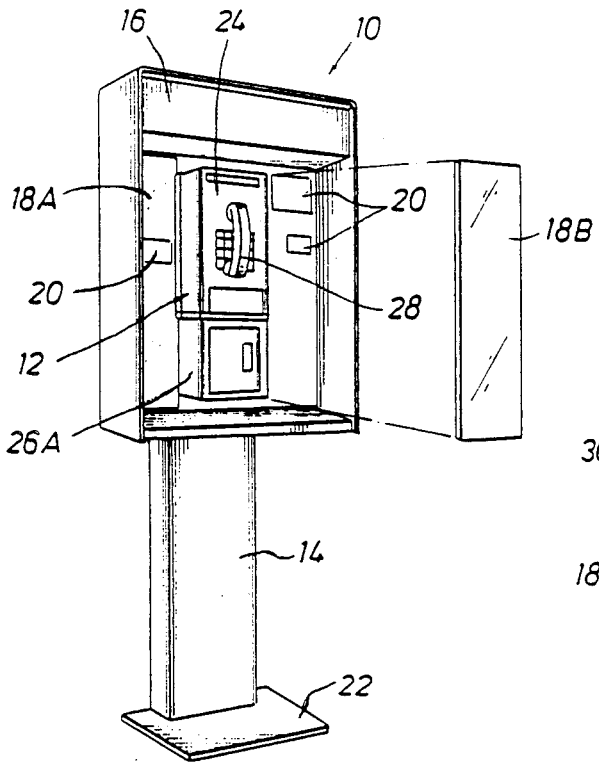
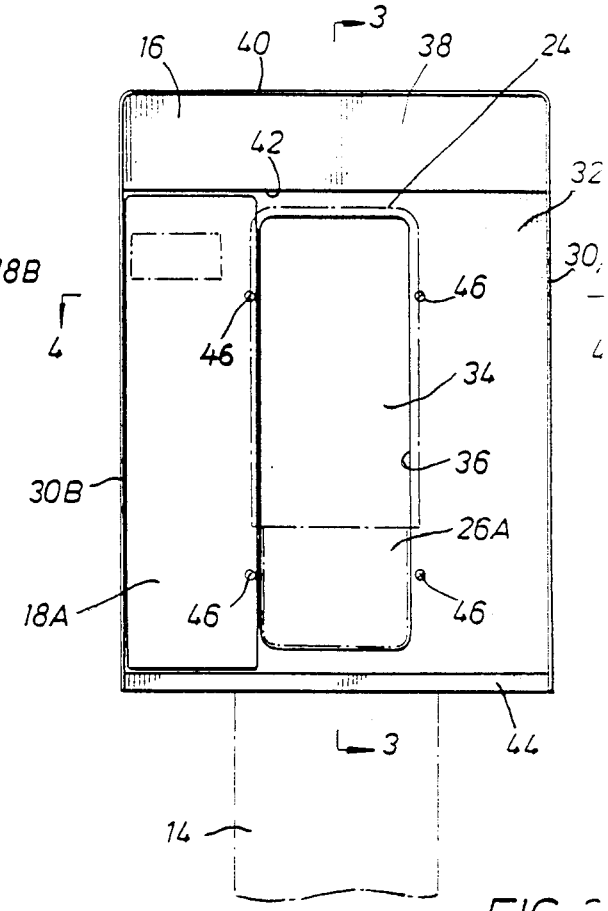
FIG. 2
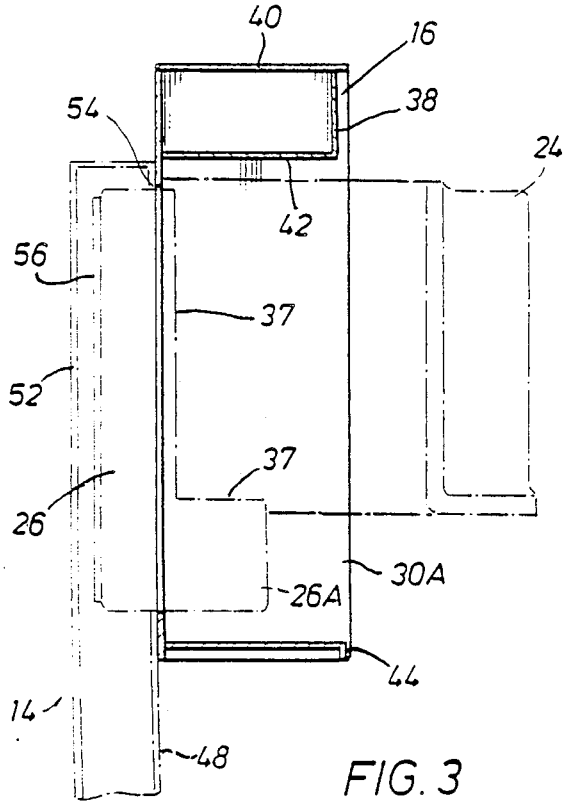
FIG. 3
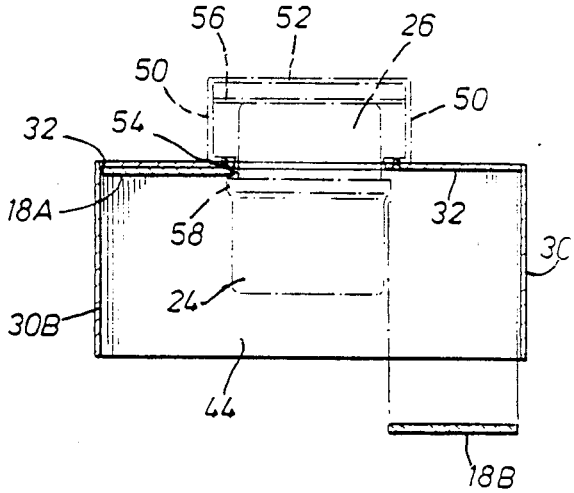
FIG. 4

ADVERTISING DISPLAY UNIT FOR A PUBLIC TELEPHONE

This application is a continuation of application Ser. No. 822,208, filed Jan. 24, 1986, now U.S. Pat. No. 4,706,399.

BACKGROUND OF THE INVENTION

1. Field of the Invention

This invention relates generally to the field of public telephone mountings, and particularly to new and improved methods and apparatus for mounting an advertising display unit for use with a public telephone.

2. Description of the Prior Art

Vandalism to public or coin telephones has long been a serious problem to the industry. The substantial increase in the incidents of such vandalism in recent years has resulted in a corresponding increase in efforts to design more secure coin telephones and telephone mounting systems. One important development in coin telephone security mounting involves recessing the telephone housing in an opening of a steel post with the rear edges of the front housing projecting forward of the post.

Other developments include the front wall of the rectangular tubular steel post embracing the top and sides of the front housing of the public telephone forward of the rear edges of the conventional raised lip of the front housing. Since these edges are recessed in the post, they are protected from prying tools. Such a telephone mounting is illustrated, for example, in U.S. Pat. No. 3,752,927.

Additionally, it has been common practice to provide an enclosure which affords weather protection, conversational privacy and additional security to the public telephone. Again by way of example, the above U.S. Pat. No. 3,752,927 discloses an enclosure which may be interchanged with a shelf without having to remove or disassemble the public telephone. The enclosure is supported on the upper end of the telephone mounting and is secured to the post by a multiplicity of fasteners. This conventional enclosure comprises a unitary aluminum ring-like enclosure that encircles the telephone a short distance from the top, bottom and sides of the telephone and extends forward of the front wall of the post.

Another example of a public telephone mounting includes U.S. Pat. No. 3,511,941. This public telephone mounting assembly includes a mounting plate fixed to a wall, the telephone secured to the mounting plate, and an enclosure secured on the wall independently of the telephone and mounting plate. The enclosure includes a back wall having an elongated aparture which receives the mounting plate. The top edge of the aperture engages a flange formed on the upper backside of the mounting plate. The enclosure includes only a backboard with side wings spaced a short distance from the sides of the public telephone.

The above patents illustrate the conventional practice of securing the enclosure independent of the telephone. This practice makes the enclosure an 'easy mark' and therefore subject to frequent vandalism. The industry has heretofore not solved the problem in providing a mounting for a public telephone having an enclosure that is vandal resistant.

Design Patent No. 263,101 discloses an ornamental design for a combined telephone booth and advertising display unit. This overhead advertising display unit is not in the line of sight of the telephone user when using the telephone receiver.

Identification of the Objects of the Invention

It is therefore an object of this invention to provide a method and apparatus for mounting an advertising display unit for use with a public telephone which is not subject to the problems of the past.

It is another object of the invention to provide a method and apparatus for providing a vandal resistant mounting for the advertising display unit.

It is another object of this invention to provide an advertising display unit which provides a display wall adjacent the public telephone having a protective transparent covering.

It is another object of the invention to provide a method and apparatus for mounting an advertising display unit which facilitates retrofitting of the invention to existing public telephone systems.

It is another object of the invention to provide an advertising display unit which provides obstruction plates for preventing access to the telephone.

It is another object of the invention to provide an advertising display unit having a display wall adjacent the public telephone for advantageously securing advertisements in the line of sight of the telephone user.

SUMMARY OF THE INVENTION

The objects identified above, as well as other advantages and features of the invention are incorporated in a vandal resistant mounting method and apparatus for an advertising display unit for use with a public telephone.

The public telephone has a rear housing and a front housing detachably secured to the rear housing. The advertising display unit mounting comprises a hollow member or post, a recessed support in an opening in the front wall of the post, an advertising unit including a display wall having an aperture and a means for preventing removal of the display wall from the post.

The rear housing of the telephone is first secured to the support. The display wall of the advertising display unit is then positioned adjacent the front wall of the post with the aperture of the display wall being received about the peripheral configuration of the rear housing. The display wall has laterally outwardly extending wall sections adjacent the aperture of the unit for display of advertisements. Additionally, a transparent covering is attached to the wall section of the display to operably shield the advertisements.

The edge of the aperture of the display wall is blocked by the rear edge of the conventional raised lip of the front housing to prevent removal of the unit from the hollow member. The advertising display unit can be removed from the post upon detachment of the front housing from the rear housing of the telephone.

BRIEF DESCRIPTION OF THE DRAWINGS

The objects, advantages and features of the invention will become more apparent by reference to the drawings which are appended hereto and wherein like numerals indicate like parts and wherein an illustrated embodiment of the invention is shown, of which:

FIG. 1 is a perspective view of a telephone mounting using the present invention;

FIG. 2 is an enlarged elevational view of the invention as shown in FIG. 1;

FIG. 3 is a sectional view of the the invention taken along line 3—3 of FIG. 2 illustrating the detachable front housing of the telephone; and FIG. 4 is a sectional view taken along line 4—4 of FIG. 2 illustrating the invention after the front housing has been secured to the rear housing of the telephone.

DETAILED DESCRIPTION OF THE INVENTION

The vandal resistant mounting apparatus 10 embodying the invention is shown in detail in FIGS. 1–4. The apparatus 10 is shown in FIG. 1 with a hollow member or post 14. The security mounting of advertising display unit 16 to the post 14 will be discussed in detail below.

The display unit 16 has transparent coverings 18A and 18B positioned laterally from the public telephone 12 to shield a plurality of advertisemsnts 20. For purposes of illustrating, the transparent covering 18B is shown in exploded view and transparent covering 18A is shown in place in FIGS. 1–4.

The post 14 is attached to a base 22 in the conventional manner with the base in turn secured to a foundation (not shown). As shown in FIGS. 1, 3 and 4 the public telephone comprises a front housing 24 and a rear housing 26. The lower housing 26A of the rear housing 26 is situated beneath the front housing 24. Lower housing 26A includes a conventional coin return shute and a vault door permanently joined to the rear housing.

The front housing 24 includes a switch hook and a push button dial and has a hand set 28 connected thereto by a cord. The front housing 24 is removably detachable from the rear housing 26. The front housing mates with the rear housing in an overlapping fashion and is secured to the rear housing by a conventional double locking bar arrangement positioned on one side of the telephone 12 (not shown).

Turning now to FIG. 2, the advertising display unit 16 has laterally positioned obstruction plates 30A and 30B forwardly extending from the display wall 32 of the unit 16. The display wall 32 has a rectangularly shaped aperture 34 therein. Th edge 36 of the aperture 34 is in close tolerance with the peripheral configuration of the rear housing 26. The aperature 34 of the unit 16 is slidably received about the peripheral configuration of the rear housing 26 and lower housing 26A. The edge 36 of the aperture 34 is blocked by the raised lip of the front housing 24, as shown by dashed lines, when the front housing 24 is secured to the rear housing 26. Therefore, when the rearward and bottom edges of the front housing overlaps adjoining edge 37 of the rear housing, edge 36 of the display wall 32 is blocked from forward movement, as will be explained in more detail below.

The fascia 38 of the unit 16 extends from the upper plate 40 to the forwardly projecting soffit 42. The fascia 38 may be used for identifying the telephone or for any other purpose. Additionally, a light fixture (not shown) may be installed in the soffit 42 or alternatively, the entire soffit and fascia be a light fixture (not shown). A shelf 44 is secured to the forwardly extending plates 30A and 30B and provides a surface preferably downwardly sloping from back to front for the convenience of the telephone user. The downward slope of shelf 44 prevents trash accumulation when in a public phone. It is to be understood that though the preferred embodiment illustrates the shelf 44 as a unitary construction with the unit 16 that a preexisting independent shelf could be secured directly to the post 14.

A plurality of screws 46 are received through holes in display wall 32 and are threadedly received into the post 14 for additional securement of the unit 16 to the post 14.

Turning now to FIG. 3, the rectangular tubular steel post 14 has a front wall 48, side walls 50, as best shown in FIG. 4, and a back wall 52. As best seen in FIGS. 3 and 4, the front wall 48 has an opening 54 for receiving the rear housing 26 of the telephone 12. The interior of the hollow member or post 14 includes support means 56 to the rear of the opening 54 for securing the rear housing of the telephone by conventional means. The support means 56 is preferably welded to the sidewalls 50, though any conventional securing means may be used. An illustrative securement of the telephone to the support means is disclosed in U.S. Pat. No. 4,246,451 and is incorporated herein for all purposes. Upper and lower blocking plates, as disclosed in U.S. Pat. No. 3,752,927, may also be used in this invention. These plates afford additional protection to the apparatus by preventing the insertion of any prying tools or chisels into the interior portion of the post adjacent the telephone.

The advertising display unit 16 is positioned adjacent the front wall 48 of the post 14 about the peripheral configuration of the rear housing 26 after the rear housing has been secured to the support means 56. The obstruction plates 30A, 30B, 40 and 42 and shelf or plate 44 of the display unit are illustrated in FIGS. 3 and 4. These plates extend forwardly of the edge of the display wall substantially a greater distance than the front surface of the telephone 12 to prevent vandalism of the telephone 12 by use of prying tools.

Turning now to FIG. 4, the front housing 24 is shown attached to the telephone rear housing 26 so that the raised lip 58 of the rearward edge of the front housing 24 laterally overlaps or blocks the edge 36 of the display wall 32 of the unit 16. As discussed above the transparent covering 18B is shown aligned with the display wall 32 in an exploded view and the transparent covering 18A is shown positioned on the display wall 32. Though FIG. 4 does not show the raised lip 58 in contact with the transparent covering 18A, it is to be understood that the positioning of the support means 56 relative to the post 14 could be fabricated such that the standard raised lip 58 would apply a compressive load to hold the transparent coverings 18 adjacent the display wall 32.

As can be understood from the description above, the vandal resistant mounting apparatus for an advertising display unit 16 provides a telephone user with a plurality of advertisements advantageously positioned on the display wall 32 in his line of sight. The display wall 32 laterally extends from the aperture 34 so as to provide sufficient room for the advertisements thereon and to draw attention to both the telephone and the advertisements.

USE AND OPERATION

The advertising display unit 16, the telephone 12, the post 14 and corresponding base 22 may be secured in either an outdoor or indoor location convenient to telephone users. The rear housing 26 is then secured to the support means 56 so that the rear housing projects from the post 14, as best shown in FIG. 3. The display wall 32 of unit 16 is then positioned adjacent the front wall 48 of the post 14 with the aperture 34 of the display wall 32 closely received about the peripherial configuration of the rear housing 26.

The front housing 24 is then secured to the rear housing 26, as shown in FIG. 4, so that the raised lip 58 on the rearward edge of the front housing blocks the display wall to prevent removal of the advertising unit from the post.

The locking bar arrangement on the front housing is then locked by a key. If authorized individuals desire to remove the display unit, the double locking bar arrangement is unlocked. The front housing is then removed thereby allowing the display unit to be slidably removed from the rear housing.

Various modifications and alterations in the described structure will be apparent to those skilled in the art of the foregoing description which does not depart from the spirit of the invention. For this reason, these changes are desired to be included in the appended claims. The appended claims recite only the limitation to the present invention in the description manner which is employed for setting forth the embodiments and is to be interpreted as illustrative and not limitative.

What is claimed is:

1. An advertising display unit adapted for use with a public telephone having a rear housing with means for mounting said telephone rear housing to a rigid member, comprising:

a display wall having an aperture, said display wall adapted for positioning adjacent said rigid member with said aperture of the display wall being received about the periphery of said telephone rear housing, said display wall having at least one outwardly laterally extending section adjacent said aperture, at least one advertisement positioned on said at least one outwardly laterally extending section of said display wall, means for fastening said display wall to said rigid member, and rigid transparent means secured to said at least one outwardly laterally extending section of said display wall for protecting said at least one advertisement, whereby a user of said public telephone when facing said telephone substantially faces said at least one advertisement on said display wall adjacent said telephone.

* * * * *